US007073699B2

(12) United States Patent
Seidler

(10) Patent No.: US 7,073,699 B2
(45) Date of Patent: Jul. 11, 2006

(54) FASTENING TOOL

(75) Inventor: Dieter Seidler, Pohleim (DE)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/505,098

(22) PCT Filed: Feb. 14, 2003

(86) PCT No.: PCT/EP03/01469

§ 371 (c)(1),
(2), (4) Date: Aug. 19, 2004

(87) PCT Pub. No.: WO03/070429

PCT Pub. Date: Aug. 28, 2003

(65) Prior Publication Data

US 2005/0081373 A1 Apr. 21, 2005

(30) Foreign Application Priority Data

Feb. 20, 2002 (DE) ..... 102 07 719

(51) Int. Cl.
*B25C 5/02* (2006.01)

(52) U.S. Cl. ..... 227/136; 227/67; 227/15; 227/18

(58) Field of Classification Search ..... 227/67, 227/136, 15, 18, 107, 112, 120, 16; 72/391.6; 29/524.1, 525.06, 525.07
See application file for complete search history.

(56) References Cited

U.S. PATENT DOCUMENTS

| | | | | |
|---|---|---|---|---|
| 2,495,070 A * | 1/1950 | Mellodge | ..... | 72/421 |
| 2,943,652 A | 7/1960 | Chilton | ..... | 81/435 |
| 5,083,483 A * | 1/1992 | Takagi | ..... | 81/434 |
| 5,144,870 A | 9/1992 | Nick | ..... | 81/434 |
| 5,388,721 A * | 2/1995 | Mauer | ..... | 221/74 |
| 5,529,233 A * | 6/1996 | Davignon et al. | ..... | 227/67 |
| 5,906,039 A * | 5/1999 | Fukami et al. | ..... | 29/566 |
| 5,988,026 A | 11/1999 | Reckelhoff et al. | ..... | 81/434 |
| 6,098,442 A | 8/2000 | Walldorf et al. | ..... | 72/391.6 |

FOREIGN PATENT DOCUMENTS

| | | |
|---|---|---|
| DE | 3 606 901 | 9/1987 |
| DE | 196 43 656 | 4/1998 |
| EP | 0 131 851 | 1/1985 |
| EP | 0 623 426 | 11/1994 |
| EP | 0 506 307 | 1/1996 |
| EP | 0 738 564 | 10/1996 |

* cited by examiner

*Primary Examiner*—Scott A. Smith
*Assistant Examiner*—Brian Nash
(74) *Attorney, Agent, or Firm*—Miles & Stockbridge P.C.

(57) ABSTRACT

A fastening tool applies parts, in particular plastic parts, to objects. The plastic parts are supplied in the form of a belt in which the plastic parts are linked together by at least one flexible web. The fastening tool transports the belt by a feed mechanism such that one plastic part at a time is delivered to a fastening position. The feed mechanism has a fluid drive that is coupled by a translation-rotation converter to a transport gear rotatably mounted on the fastening tool and designed to positively or nonpositively engage the belt in order to transport it. The translation-rotation converter has an overrunning clutch whose driving gear is kinematically coupled to the fluid drive and whose driven gear is coupled to the transport gear in a rotationally fixed manner.

12 Claims, 3 Drawing Sheets

FASTENING TOOL

BACKGROUND OF THE INVENTION

The present invention relates to a fastening tool for applying plastic parts to objects wherein the plastic parts are supplied in the form of a belt in which the plastic parts are linked together by means of at least one flexible web, wherein the fastening tool is designed to transport the belt by means of a feed mechanism such that one plastic part at a time is delivered to a fastening position, and wherein the feed mechanism has a fluid drive that is coupled by a translation-rotation converter to a transport gear that is rotatably mounted on the fastening tool and is designed to positively or nonpositively engage the belt in order to transport it.

Such a fastening tool is known from DE 196 43 656 A1.

In many areas of prior art, it is necessary to attach parts to objects, for example nails in wooden objects, screws in wooden objects, plastic parts on metal objects such as metal sheets, etc.

The attachment of plastic parts, frequently called clips, to prepared or unprepared metal sheets, for example to welding studs, is an economically important field. In the automotive field, a variety of such plastic parts are attached to the vehicle body to perform holding functions, for example to support instrument panels, hold interior trim, carpeting, brake lines, electrical wiring, etc.

Since it is frequently necessary to attach a number of identical plastic parts in various positions in rapid sequence, the appropriate feeding of the plastic parts and the proper positioning of the plastic parts in the correct orientation prior to the actual fastening process is especially important.

It is an industry standard to provide the plastic parts as bulk material and then to separate them (using a vibrator, for example). Subsequently, one plastic part at a time is brought into fastening position by means of an appropriate feeding device.

Alternatively, there is known from EP 0,506,307 B1 a belt wherein the plastic parts are linked one after the other. Here, the plastic parts are molded onto one or two flexible webs during their molding process (generally by injection molding), where the flexible webs are either joined to other flexible webs or are fed into the injection molding machine as a continuous web. The belt is rolled up and transported to the production site in the rolled-up state.

This method of supplying plastic parts is offered by the company Tucker GmbH under the name "Plastifast."

A fastening tool for attaching plastic parts supplied in this form is known from the aforementioned DE 196 43 656 A1.

In this prior art, the fastening tool has a housing with a handgrip. Supported on the housing is a magazine with two longitudinal webs into which the belt with the plastic parts is inserted. From there, the plastic parts are delivered to a head wherein the plastic parts are deflected in curved guides. Also located on the head is a feed mechanism to transport the belt.

The feed mechanism has a transport gear that positively engages the belt. The transport gear is coupled to a pneumatic drive by a translation-rotation converter. The translation-rotation converter has a number of laterally projecting pins at the transport gear. The pitch of these pins corresponds to the pitch of the teeth on the outer circumference of the transport gear.

The pneumatic drive has a carrier element that moves translationally back and forth and that "catches" one pin during each backward motion and "pushes against" one pin in front of it during each forward motion in order to turn the transport gear.

A complicated ratchet mechanism makes it possible for the carrier element to move backwards without moving the transport gear backwards.

The feed mechanism disclosed in this document can be improved from both functional and design standpoints. In order to ensure that a plastic part arrives at a fastening position every time even when problems arise in the transport mechanism, an external handwheel is provided by means of which the transport gear can be turned by hand.

Known from EP 0,131,851 A1 is a device for inserting and/or removing screws. In this device, screws are automatically fed, wherein the screws are inserted into a strip-shaped magazine and are pushed into a fastening position by spring pressure.

A similar mechanism is also known from U.S. Pat. No. 2,943,652.

A "machine-gun-style" lateral feeding of strips of nails to a fastening tool is known from DE 3,606,901 A1.

In addition, a fastening tool for inserting screws is known from U.S. Pat. No. 5,144,870. The screws are fed from a belt into a guide. The screws are fed by a spring-loaded drive oriented in the longitudinal direction which has a gear rack which an elastically-preloaded tooth engages.

All of the above-mentioned solutions for fastening tools are either very costly or not very reliable in their designs.

BRIEF DESCRIPTION OF THE INVENTION

In view of this situation, an object of the present invention is to specify a fastening tool which has a feed mechanism that is simple in design and reliable.

This object is attained with the aforementioned fastening tool for attaching parts to objects in that the translation-rotation converter has an overrunning clutch whose driving gear is kinematically coupled to the fluid drive and whose driven gear is coupled to the transport gear in a rotationally fixed manner.

Overrunning clutches are devices wherein the connection between two shafts is released when the driven shaft rotates faster than the driving shaft. Thus, torque can only be transmitted in one direction of rotation.

Such overrunning clutches are commercially available as prefabricated components.

In the scope of the present invention, the overrunning clutch makes it possible for a translationally acting fluid drive to convert stroke motions of a certain extent into rotational motions of the transport gear. In contrast, the return stroke is not transmitted to the transport gear.

Overall, this results in a simple and robust feed mechanism for the fastening tool.

The object is fully attained in this manner.

The fluid drive preferably has a piston/cylinder device with a variable stroke.

In the present context, "variable stroke" means that the piston/cylinder device need not necessarily perform its full stroke during every actuation process. For example, the stroke depends on the opposing force present.

In this way, it is possible to variably achieve a specified stroke through a sum of multiple full strokes and one partial stroke.

In this way, the design complexity as a whole is further reduced.

It is particularly advantageous when the fluid drive is a pneumatic drive.

Compressed air is a working medium that is commonly present in the production facilities in question here. Of course, it is also possible to implement the fluid drive hydraulically as an alternative.

In accordance with an embodiment that is preferable as a whole, the driven gear is arranged coaxially inside the driving gear.

This has the consequence that the fluid drive can exert a larger torque on the driving gear as a result of its larger radius. It is also advantageous that the driven gear can have a larger axial extent, for example in order to support multiple individual transport gears in a rotationally fixed manner.

Alternatively, it is also possible, however, for the driving gear to be located coaxially inside the driven gear.

In this case, the driven gear can also be the transport gear.

Moreover, it is advantageous for the transport gear to be removably coupled to the driven gear of the overrunning clutch.

In this way, it is possible to easily refit the fastening tool for different kinds of parts, specifically in that a transport gear adapted to the spacing-and/or shape of the parts on the particular belt is used.

It is also advantageous when the transport gear is embodied as a ring gear that can be pushed onto the driven gear of the overrunning clutch.

In this way, the transport gears can be manufactured in a relatively simple way. The rotationally fixed connection can be solely frictional (press-fit). However, a keyed connection or a similar coupling that is positive-acting in the rotational direction is preferred.

In a particularly preferred embodiment, the driving gear of the overrunning clutch is coupled to the fluid drive by means of a crank mechanism.

Crank mechanisms can be designed so as to be relatively simple and robust.

In this regard, it is especially preferred for the driving gear to have a laterally projecting pin that engages a longitudinal recess in a connecting block that is coupled to the fluid drive.

It is a matter of course that the longitudinal recess is oriented transverse, and preferably perpendicular, to the stroke direction of the fluid drive. In this way, the longitudinal recess can convert stroke motions into rotational motions of the driving gear and accommodate the resulting motion of the pin transverse to the stroke direction.

On the whole, it is additionally advantageous for the fastening position to be defined by a stop.

In accordance with an especially preferred embodiment, during a transport process the fluid drive subjects the translation-rotation converter to a drive force by means of which the next plastic part to be fastened is transported to a stop that defines the fastening position.

During operation, the fluid drive generally exerts a force (which can be variable on account of the differing torques at the translation-rotation converter) on the transport gear and consequently on the plastic parts to be transported. As a result, it is not necessary to adjust the feed mechanism's extent of motion to the particular spacing of the plastic parts on the belt. The part in the forwardmost position is transported into the fastening position in that the fluid drive is actuated until the part is in the fastening position. Depending on the spacing of the plastic parts it may be necessary to perform multiple individual strokes during this process.

As soon as the plastic part strikes the stop, and thus is in the fastening position, a corresponding opposing force acts on the fluid drive, so that the latter stays in the last position it has assumed. With continuing actuation, the fluid drive then continues to press the plastic part against the stop, for example, so that exact positioning in the fastening position is always ensured. Alternatively, the overrunning clutch implements the position-holding in that the driven gear supports itself thereupon.

On the whole, it is further preferred if the driving gear has a predefined scope of rotational motion of less than 180°.

This is because it is important that the overrunning clutch property is used such that the return stroke of the fluid drive results in a reverse rotation of the driving gear. As a rule, the scope of rotational motion will be significantly less than 180°. The precise values, however, depend on the design parameters, the tribological properties of the materials used, etc.

It is a matter of course that the features described above and those that are described below can be used not just in the combinations described, but also individually or in other combinations, without exceeding the scope of the present invention.

BRIEF DESCRIPTION OF THE DRAWINGS

Example embodiments of the invention are depicted in the drawings and are explained in detail in the descriptions that follow. Shown in.

DETAILED DESCRIPTION OF THE INVENTION

Figure 1:
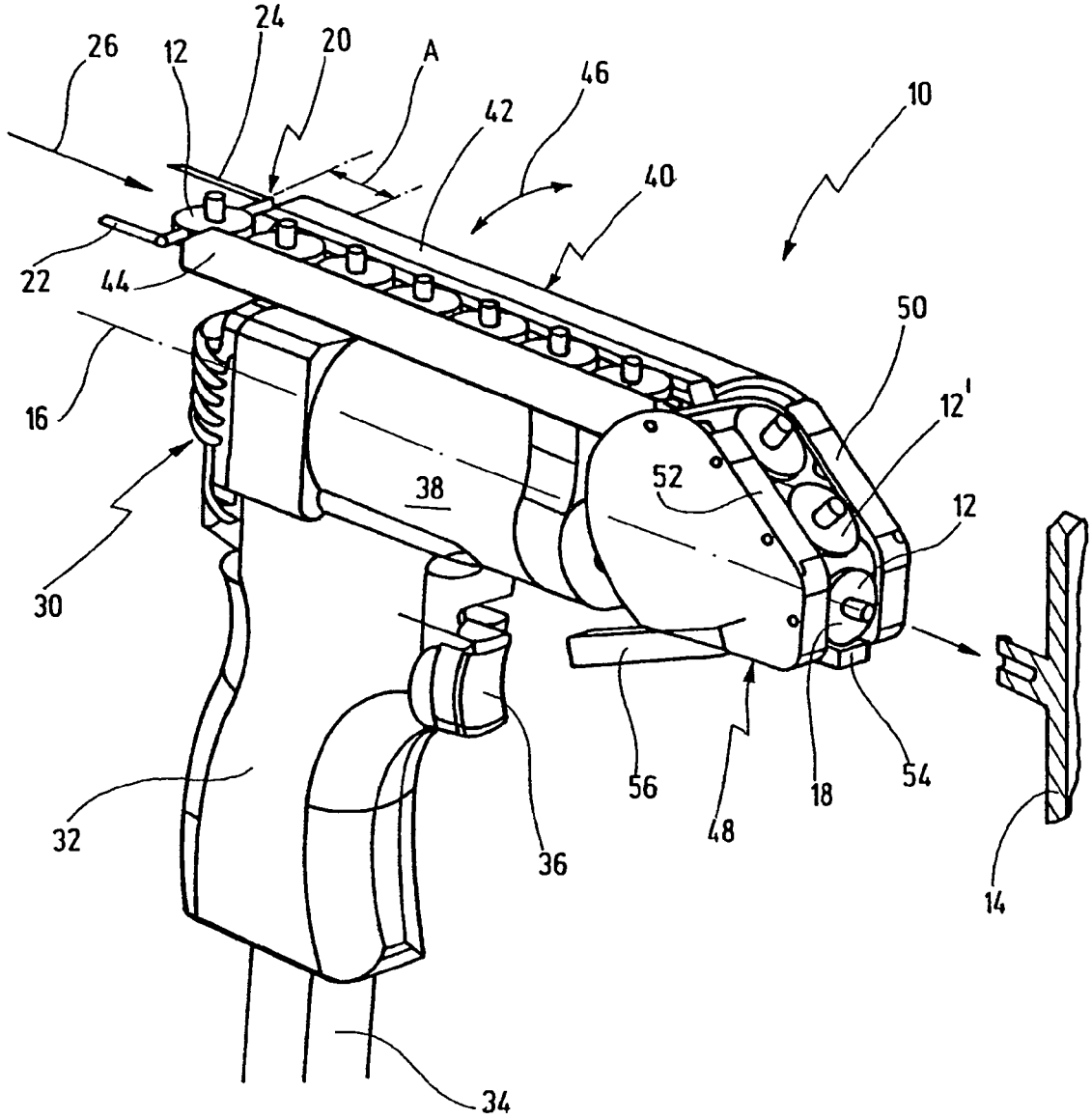
FIG. 1 is a schematic perspective view of a fastening tool in accordance with prior art.

In FIG. 1, a fastening tool in accordance with prior art is labeled 10 as a whole.

The general construction of the fastening tool corresponds to the fastening tool disclosed in the document DE 196 43 656 A1.

The fastening tool 10 serves to attach plastic parts 12 to an object 14.

For this purpose, a plastic part 12 is transported to a forward-located fastening position 18 that is aligned with a longitudinal axis 16 of the fastening tool 10.

In the present case, the plastic part 12 has a cylindrical projection that is inserted into a blind hole of an object 14.

Alternatively, the projection of the plastic part 12 could also be tubular in design. In this case, there would for example be a projecting stud provided on the object 14, welded on by a stud-welding process, for example.

The fastening tool 10 is not limited to the plastic part 12 shown. Rather, a number of different plastic parts 12 can be fastened to a wide variety of different objects 14 using the fastening tool 10.

In every case, the plastic parts 12 are provided in the form of a belt 20. The belt 20 has two parallel flexible webs 22, 24. The plastic parts 12 are injection-molded onto the webs 22, 24 with a predefined spacing A.

Such a belt is known in principle from the aforementioned EP 0,506,307 B1.

The belt 20 is inserted into the fastening tool 10 from behind in a feeder device 26 that is oriented approximately parallel to the longitudinal axis 16. The belt can, for example, be provided rolled up on appropriate carriers and is automatically unrolled therefrom by the fastening tool 10 as described below.

The fastening tool 10 has a housing 30, from the bottom of which extends a hand grip 32.

Supply lines 34 are connected to the bottom of the hand grip, in the present case a compressed air line and an electrical supply line.

A switch 36 for actuation by the index finger is provided on the hand grip.

Actuating the switch 36 causes the plastic part 12 that is located in the fastening position 18 to be separated from the webs 22, 24 and applied to the object 14. Moreover, the following plastic part 12' is subsequently transported to the fastening position 18.

The housing 30 also has a magazine holder 38 on which an elongated magazine 40 is supported. The magazine 40 has two parallel longitudinal profiles 42, 44 that are oriented approximately parallel to the longitudinal axis 16. The belt 20 is passed between the longitudinal profiles 42, 44. The magazine 40 has a length such that a predefined number of plastic parts 12, in the present case approximately six, are lined up one behind the other in the magazine 40. The belt 20 is held in a stabilized manner in the axial direction in the magazine 40. Moreover, the magazine 40 is designed so as to swivel about the longitudinal axis 16, as is schematically indicated under 46.

In addition, the housing 30 has a head 48 that adjoins the front of the magazine 40. When the magazine 40 swivels, the head 48 is swiveled with it.

Provided on the head 48 are two curved profiles 50, 52 which constitute a continuation of the longitudinal profiles 42, 44 and deflect the belt 20 by approximately 90°.

A transverse stop 54 that defines the fastening position 18 is located at the end of the curved profiles 50, 52.

Moreover, located below the head 48 is a collecting means 56 for the webs 20, 22, which are fed out downward after the plastic parts 12 are separated at the fastening position 18.

Figure 2:
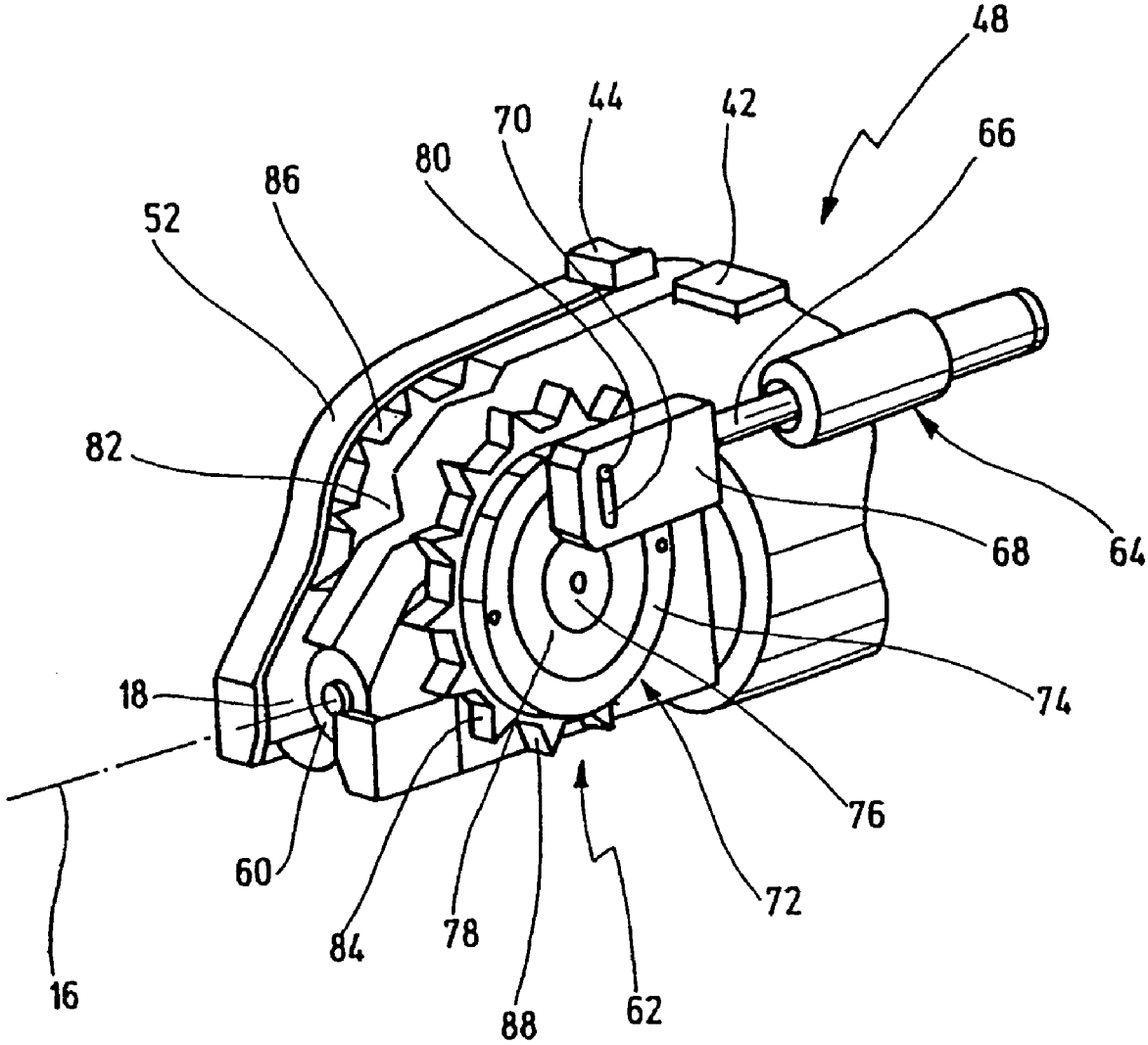
FIG. 2 is the head of a fastening tool in accordance with the present invention, in a partially sectional view.

FIG. 2 shows a perspective view of the head 48 in a partially sectional representation.

It can be seen that a ram 60 aligned with the longitudinal axis 16 is provided in the head 48. When the fastening tool 10 is actuated, the ram 60 is moved forward to separate the plastic part 12 that is located in the fastening position 18 from the webs 20, 22 and attach it to the object 14.

Moreover, a feed mechanism 62 is provided in order to further transport the belt 20 after each fastening operation so that the next plastic part 12' arrives at the fastening position 18.

The construction of the fastening tool 10 described thus far corresponds to the construction of the fastening tool that is known from the aforementioned DE 196 43 656 A1.

The present fastening tool 10 differs therefrom in particular through the feed mechanism 62.

The feed mechanism 62 has a fluid drive in the form of a piston/cylinder device 64 aligned approximately parallel to the longitudinal axis 16. The piston/cylinder device 64 is connected to the pneumatic line 34, which is not shown in the figures.

A piston 66 of the piston/cylinder device 64 extends forward, parallel to the longitudinal axis 16, and is rigidly connected to a connecting block 68.

The connecting block 68 has a connecting hole 70 perpendicular to the piston axis.

An overrunning clutch device 72 is provided next to the connecting block 68.

The overrunning clutch device 72 has an external driving gear 74 and an internal driven gear 76, with an overrunning hub 78 disposed between them. The structure of such overrunning hubs is known per se, so the internal structure is not described in detail here.

Provided on the driving gear 74 is a laterally projecting pin 80 that engages in the elongated hole 70.

During forward stroke motions of the piston/cylinder device 64 (out of the plane of the picture in FIG. 2), the pin 80 is carried along by the connecting block 68 so that the driving gear 74 turns. The overrunning hub 78 is arranged such that the driven gear 76 is carried along in this rotation.

On the return stroke of the piston/cylinder device 64, the connecting block 68 is moved back and again takes the pin 80 with it. During this process, the driving gear 74 is rotated back to the starting position. The driven gear 76 remains in its previous position.

Hence, the connecting block 68, the elongated hole 70, the overrunning clutch device 72 and the pin 80 constitute a translation-rotation converter.

In the present case, the driven gear 76 is designed as a shaft that runs transverse to the longitudinal axis 16 over nearly the entire width of the head 48.

Two transport gears 84, 86 of a transport gear arrangement 82 are attached to the driven gear 76 in a rotationally fixed manner.

The transport gears 84, 86 are each arranged in the vicinity of the curved profiles 50 or 52, respectively, and engage the belt 20 symmetrically about a center line which is not shown. In other words, the plastic parts 12 are transported between the two transport gears 84, 86.

The outer circumferences of the transport gears 84, 86 are provided with teeth 88 in order to be able to positively engage the belt 20.

The function of the feed mechanism 62 and of the associated overrunning clutch device 72 is described below on the basis of schematic FIGS. 3 and 4.

Figure 3:
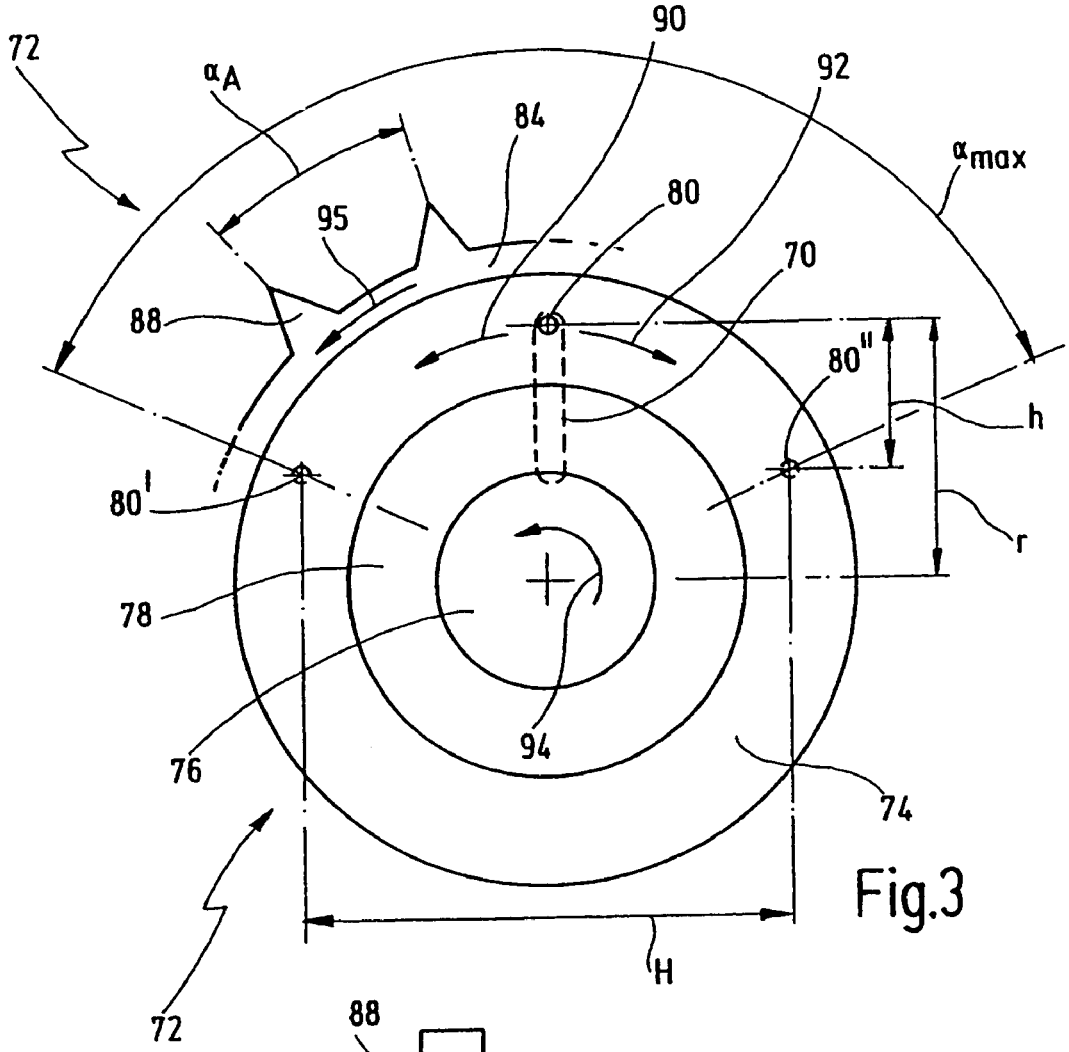
FIG. 3 is a schematic side view of the feed mechanism of the head shown in FIG. 2.

FIG. 3 shows the direction of rotation 90 of the driving gear 74 during a forward stroke of the piston/cylinder device 64. The direction of rotation of the driving gear 74 during a return stroke is labeled 92. The only direction of rotation of the driven gear 76 is labeled 94. The directions of rotation 90 and 94 are identical. The only direction of rotation of the transport gear 84 is labeled 95.

The teeth 88 are spaced apart in the circumferential direction by an angle $\alpha_A$ which corresponds to the spacing A of the plastic parts 12 on the belt 20. The teeth 88 can be radially slotted in order to accommodate the webs 20 and 22, but this is not shown in the diagrams. The longitudinal extent of the elongated hole 70 is labeled h. The longitudinal extent h of the elongated hole 70 determines the extent of motion of the driving gear 74. Starting from the center position shown in FIG. 3, the driving gear can be moved in the direction of rotation 90 until the pin 80 strikes the lower end of the elongated hole 70, indicated by 80'. In the opposite direction of rotation 92, the corresponding position of the pin 80 is labeled 80".

Thus, a maximum angle of rotation $\alpha_{max}$ of the driving gear 74 of less than 180° results. It is a matter of course that the angle $\alpha_{max}$ must be significantly smaller than 180° in order to avoid self-locking, at least when the friction between the pin 80 and the internal circumference of the elongated hole 70 is not negligible. In FIG. 3, the angle $\alpha_{max}$ is approximately 130°. However, significantly smaller and larger angles can be chosen as a function of tribological boundary conditions.

The longitudinal extent h of the elongated hole 70 is always smaller than the radius r that separates the pin 80 from the center point of the overrunning clutch device 72. This ensures that the driving gear 74 does not execute a full rotation, but instead is only turned back and forth.

The stroke distance of the piston/cylinder device 64 defined by the distance between the positions 80' and 80" is shown as H.

Figure 4:
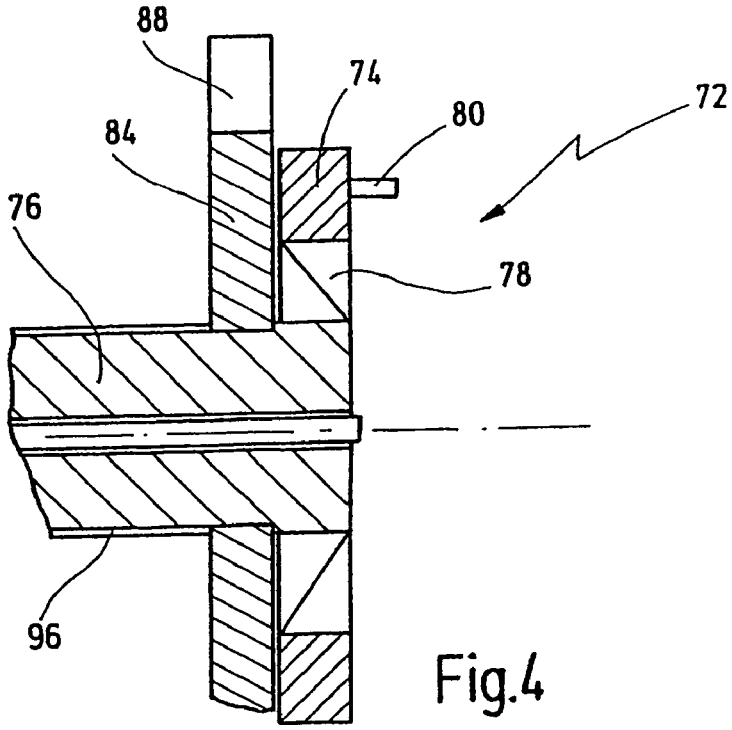
FIG. 4 is a schematic partial axial sectional view of the feed mechanism from FIG. 3.

It can also be seen from FIG. 4 that the driven gear 76, which is only partially visible, can be provided with a keyway 96 to make it possible to easily connect the transport gears 84, 86 to the driven gear 76 in a rotationally fixed manner.

During operation, the transport of a subsequent plastic part 12' into the fastening position 18 is performed as follows.

The piston/cylinder device 64 is subjected to compressed air. Consequently, the driving gear 74 is rotated in the direction of rotation 90. If the plastic part 12' arrives at the fastening position 18 before the pin 80 is in the end position 80', the transport process is completed. However, the piston/cylinder device 64 continues to be subjected to compressed air in order to hold the plastic part 12' in the fastening position 18. Alternatively, the supply of compressed air to the piston/cylinder device 64 is stopped as soon as the plastic part 12' is in the fastening position 18.

If the plastic part 12' has not yet reached the fastening position 18 when the pin 80 is in the end position 80', a return stroke of the connecting block 68 takes place. As a result of the overrunning hub 76, the transport gears 84, 86 remain in the position they have reached. As soon as the connecting block has brought the pin 80 into the position 80", the stroke direction is reversed again. The driving gear 74 then carries the driven gear and consequently the transport gears 84, 86 with it once more. This process is continued until the plastic part 12' is in the fastening position 18.

Of course, the number of repetitions is a function of the stroke H and of the spacing A of the plastic parts 12 on the belt 20.

If plastic parts other than the plastic parts 12 shown are to be fastened using the fastening tool 10, the transport gears 84, 86 are exchanged for transport gears that are matched to the other plastic parts. It is a matter of course that for the other transport gears 84, 86 the shape of the teeth 88 as well as their angular spacing $\alpha_A$ can be different from those of the transport gears 84, 86 shown. However, the effective outer diameter of the transport gears 84, 86 is the same for all different types of plastic parts. Adaptation in this regard is not necessary, since the transport mechanism 62 shown can achieve the spacing A corresponding to one transport step using either one stroke H, a partial stroke, or a number of strokes H plus a partial stroke if required.

If only one partial stroke is necessary, it is possible to either design the piston/cylinder device with a variable stroke such that it again initiates a return stroke starting at the end position of the partial stroke, or alternatively, it is also possible to keep the stroke constant and to continue it from a given position that corresponds to that of a plastic part in the attachment position 18.

Instead of an arrangement of the driving gear coaxially outside the driven gear, it is also possible to arrange the driving gear coaxially inside of the driven gear.

Moreover, in the present case it is advantageous with regard to the assembled depth in the direction of the width of the fastening tool 10 for the transport gears 84, 86 to be embodied as ring gears. However, it is also possible to design them as solid gears and to provide other means for rotationally fixed coupling with the driven gear 76.

Instead of the crank mechanism with the connecting block 68 and the pin 80, other crank mechanisms or other types of translation-rotation converters are also possible.

The invention claimed is:

1. Fastening tool (10) for applying parts (12), in particular plastic parts (12), to objects (14), wherein the plastic parts (12) are supplied in the form of a belt (20) in which the plastic parts (12) are linked together by means of at least one flexible web (22, 24) wherein the fastening tool (10) is designed to transport the belt (20) by means of a feed mechanism (62) such that one plastic part (12) at a time is delivered to a fastening position (18), and wherein the feed mechanism (62) has a fluid drive (64) that is coupled by a translation-rotation converter (68, 70, 72) to a transport gear (84) that is rotatably mounted on the fastening tool (10) and is designed to positively or nonpositively engage the belt (20) in order to transport it, characterized in that the translation-rotation converter (68, 70, 72, 80) has an overrunning clutch (72) with a bidirectionally rotating driving gear (74) and a driven gear (76), the driving gear (74) being kinematically coupled to the fluid drive (64), the driven gear (76) being coupled to the transport gear (84) in a rotationally fixed manner, the clutch (72) being constructed so that the driven gear (76) is driven only by unidirectional rotation of the driving gear (74).

2. Fastening tool in accordance with claim 1, characterized in that the fluid drive (64) has a piston/cylinder device (64) in which a piston has a variable stroke in a cylinder.

3. Fastening tool in accordance with claim 1, characterized in that the fluid drive (64) is a pneumatic drive (64).

4. Fastening tool in accordance with claim 1, characterized in that the driven gear (76) is arranged coaxially inside the driving gear (74).

5. Fastening tool in accordance with claim 1, characterized in that the driving gear is arranged coaxially inside the driven gear.

6. Fastening tool in accordance with claim 1, characterized in that the transport gear (84) is removably coupled to the driven gear (76) of the overrunning clutch (72).

7. Fastening tool in accordance with claim 1, characterized in that the transport gear (84) is a ring gear (84).

8. Fastening tool in accordance with claim 1, characterized in that the driving gear (74) of the overrunning clutch (72) is coupled to the fluid drive (64) by means of a crank mechanism (68, 70, 80).

9. Fastening tool in accordance with claim 8, characterized in that the driving gear (74) has a laterally projecting pin (80) that engages a longitudinal recess (70) in a connecting block (68) that is coupled to the fluid drive (64).

10. Fastening tool in accordance with claim 1, characterized in that the fastening position (18) is defined by a stop (54).

11. Fastening tool in accordance with claim 1, characterized in that during a transport process the fluid drive (64) subjects the translation-rotation converter (68, 70, 72, 80) to a drive force by means of which the next plastic part (12) to be fastened is transported to a stop (54) that defines the fastening position (18).

12. Fastening tool in accordance with claim 1, characterized in that the driving gear (74) has a predefined arcuate range of bidirectional rotational motion of less than 180°.

* * * * *